US006682583B1

(12) United States Patent
Morioka et al.

(10) Patent No.: US 6,682,583 B1
(45) Date of Patent: Jan. 27, 2004

(54) PROCESS FOR PRODUCING SINTERED ORE AND THE SINTERED ORE

(75) Inventors: Kouichi Morioka, Kakogawa (JP); Toshihide Matsumura, Kakogawa (JP); Jyunpei Kiguchi, Kakogawa (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/572,459

(22) Filed: May 17, 2000

(30) Foreign Application Priority Data

May 21, 1999 (JP) ..... 11-141669

(51) Int. Cl.[7] ..... C22B 1/16
(52) U.S. Cl. ..... 75/319; 75/322; 75/769
(58) Field of Search ..... 75/319, 322, 769, 75/758, 472, 768

(56) References Cited

U.S. PATENT DOCUMENTS 3,975,183 A * 8/1976 Gross et al. ..... 75/758
3,980,465 A * 9/1976 Nishida et al. ..... 75/319
4,684,549 A * 8/1987 Allen et al. ..... 75/772
6,241,808 B1 * 6/2001 Morioka et al. ..... 75/768

FOREIGN PATENT DOCUMENTS

| | | |
|---|---|---|
| DE | 1 029 568 | 5/1956 |
| DE | 41 16 334 A1 | 3/1992 |
| DE | 197 12 042 C1 | 6/1998 |
| JP | 4-80327 | 3/1992 |

* cited by examiner

*Primary Examiner*—Melvyn Andrews
(74) *Attorney, Agent, or Firm*—Oblon, Spivak, McClelland, Maier & Neustadt, P.C.

(57) ABSTRACT

Provided is a process for producing sintered ore in which a small amount of a water-soluble compound (a sintering aid) is added to iron ore powder and, thereby, which product shows improved strength and no adverse influence as an ironmaking raw material either without any increase in content of an auxiliary material (CaO) serving as a binder. In production of sintered ore, an aqueous solution is added to iron ore powder and an auxiliary material, the iron ore powder and the auxiliary material are kneaded to form a mixture, and the mixture is granulated to form granules, wherein the aqueous solution contains a water-soluble compound reacting with the iron ore powder to form a reaction product having a melting point of 1200° C. or lower.

8 Claims, 3 Drawing Sheets

PROCESS FOR PRODUCING SINTERED ORE AND THE SINTERED ORE

BACKGROUND OF THE INVENTION

1. Field of the Invention

The present invention relates to a process for producing sintered ore used as a raw material in ironmaking and sintered ore produced by means of the process and particularly, to a process for producing the sintered ore which product shows improved strength, and sintered ore produced by means of the process.

2. Description of the Prior Art

Production of sintered ore used as a raw material in ironmaking is generally performed in a preliminary process for a sintering raw material shown in FIG. 5. This preliminary process includes steps of: mixing and granulation with raw material tanks 1 and a drum mixer 2; and sintering with an ore feed hopper 3 and a sintering machine 4. The sintering raw material is composed of: iron ore powder of about 10 mm or less in particle size; auxiliary materials, such as lime stone, quick lime, silica rock and serpentine; and solid fuel, such as coke, and components of the sintering raw material are stored in the raw material tanks 1. The components of the sintering raw material are charged into the drum mixer 2 at a predetermined composition, then, a proper amount of water is added thereto and the components are mixed and granulated in the drum mixer 2. Granules thus formed are packed on a pallet of a sintering machine (for example, a Dwight-Lloyd sintering machine) 4 to a predetermined height by the ore feed hopper 3 and solid fuel in a top surface section of the packed raw material is ignited. After the ignition, burning of the solid fuel is continued while the air is sucked downward and the sintering raw material is sintered by a combustion heat to form a sinter cake. This sinter cake is pulverized, followed by particle size adjustment to obtain a sintered ore product of 3 mm or more in particle size.

A sintered ore product requires high strength as a raw material in ironmaking. This is to prevent not only reduction in production yield due to pulverization of sintered ore in the course of charging it into a blast furnace but deterioration in blast furnace operating conditions due to reduction in air flowing-through property through a blast furnace from pulverization of sintered ore in the furnace.

In order to improve the strength of the sintered ore product, it is important that a high temperature is generated in the granules packed on the pallet of the sintering machine by combustion of solid fuel in the granules and this high temperature is maintained, so that a sufficient amount of a melt for sintering of iron ore powder is formed in a uniform manner in the bulk of the sintering raw material.

The melt is formed by a slag reaction between iron ore and the auxiliary materials, the melt being, in general, a multi-component system calcium-ferrite. With the melt, liquid phase sintering of iron ore powder is effected and after cooling, bonds between particles of the iron ore powder are formed.

It has widely been known that the strength of a sintered ore product is increased either when a bond is wide or when bonds are constructed in a network structure.

For this reason, it has been understood that the strength of a sintered ore product can be improved when a sufficient amount of a melt for sintering iron ore powder is produced to extend a width of a bond and in addition, the melt is produced in a uniform manner in the bulk of the sintering raw material to achieve a uniform network structure of bond.

An air flowing-through resistance of a granule bed packed on the pallet of the sintering machine has generally been reduced in order that a high temperature is generated and maintained by combustion of solid fuel included in the granules as described above. With the reduced air flowing-through resistance, much of air can be passed through the bed and the solid fuel can be efficiently burned in a uniform manner, thereby enabling a high temperature at which a high strength sintered ore product can be produced (sintered) to be achieved and maintained.

It has been adopted, in order to reduce an air flowing-through resistance, that a sintering raw material is prepared so as to be of coarse granules by either making primary particles of the sintering raw material larger in size or promoting a granulating nature of the sintering raw material and thereby improving a degree of agglomeration.

In order to promote the granulating nature of the sintering raw material, a binder, such as quick lime, bentonite, cement or cement clinker in powder, has been added to the raw material.

However, in company with recent decrease in output of good quality iron ore, the number of brands of iron ores in use has increased and thereby, a granulating nature of a sintering raw material is largely affected by characteristics of brands. To be detailed, a granulating nature of a sintering raw material has recently decreased with decrease in content of a coarse raw material, use of iron ore of a brand poorer in granulating nature, and increase in content of return sintered ore also poorer in granulating nature. As a result, there has been arisen a problem, since an air flowing-through property of a sintering raw material is degraded, thereby decreasing the strength of a sintered ore product.

In such circumstances, much of a binder has been added to a sintering raw material in order to improve a granulating nature.

However, there has arisen a problem in which a process where much addition of a binder into a sintering raw material leads to increase in production cost of sintered ore. Besides, addition of a large amount of a binder to a sintering raw material makes a composition of an ironmaking raw material fall off a scope allowed as the raw material, thereby influencing operation of a blast furnace adversely.

In addition to the above described problems associated with a binder, an improvement effect on the granulating nature of a sintering raw material has a maximum in regard to an additive amount of a binder and if the binder is added more than the maximum, the granulating nature of the sintering raw material has a chance of degradation.

OBJECT AND SUMMARY OF THE INVENTION

It is accordingly an object of the present invention to provide a process for producing sintered ore in which a small amount of a water-soluble compound (a sintering aid) is added to iron ore powder and, thereby, which product shows an improved strength and no adverse influence as an ironmaking raw material either without any increase in content of an auxiliary material (CaO) serving as a binder.

The present invention to achieve the above described object is directed to a process for producing sintered ore in which an aqueous solution is added to iron ore powder and an auxiliary raw material and the iron ore powder and the auxiliary raw material are kneaded to form a mixture, and the mixture is granulated to form granules, followed by sintering the granules, wherein the aqueous solution contains a water-soluble compound reacting with the iron ore powder to form a reaction product having a melting point of 1200° C. or lower.

Since a compound reacting with iron ore powder to form a reaction product having a melting point of 1200° C. or lower and preferably 1150° C. or lower is soluble in water, an aqueous solution containing the water-soluble compound makes wet surfaces of particles of the iron ore powder with certainty, so that coating of the surfaces of the particles of the iron ore powder with the compound can be ensured when drying the iron ore powder prior to sintering in a sintering step. As a result, the water-soluble compound and the iron ore powder can efficiently react with each other.

Therefore, the reaction between the water-soluble compound and the iron ore powder can be efficiently performed at a conventional sintering temperature ranging from 1150° C. to 1200° C. for sintered ore to form a melt, with the result that melt formation through a slag reaction between the iron ore powder and the auxiliary material is accelerated in the presence of the melt from the water-soluble compound and thereby, a sufficient amount of a melt for sintering the iron ore powder is additionally produced, which enables the strength of a sintered ore product to be improved.

Further, as described above, since an aqueous solution containing a water-soluble compound makes wet surfaces of particles of iron ore powder with certainty so that coating of the surfaces of the particles of the iron ore powder with the compound can be ensured to the full extent, therefore the water-soluble compound which the aqueous solution contains can be reduced in quantity, for example to be 1 mass %, and there can be produced a sintered ore product showing no adverse influence on operation in a blast furnace to be otherwise exerted because of the presence of an element constituting the water-soluble compound therein.

Furthermore, an aqueous solution preferably contains a water-soluble compound producing a reaction compound having a melting point ranging from 550 to 900° C. through a reaction with iron ore power.

A water-soluble compound which an aqueous solution contains reacts with iron ore powder to form a reaction compound having a melting point ranging 550 to 900° C., thereby, a melt can be produced at a temperature lower than a conventional sintering temperature ranging 1150 to 1200° C. of sintered ore, and thus produced melt accelerates production of a additional melt through a slag reaction between the iron ore powder and an auxiliary material to a sufficient amount of the melt for sintering the iron ore powder, which enables the strength of a sintered ore product to be improved.

A water-soluble compound of the process of the present invention plays a role of a sintering aid accelerating sintering through a slag reaction between iron ore powder and an auxiliary material.

That is, migration (diffusion) of components of the iron ore powder and the auxiliary material becomes easy with the help of a melt produced by a reaction between the water-soluble compound and the iron ore powder, which accelerates production of an additional melt through a slag reaction between the iron ore powder and the auxiliary material, whereby, it is estimated, sintering of iron ore powder is sufficiently progressed.

Furthermore, it can be expected that a component of a melt produced by a reaction of a water-soluble compound with iron ore powder reduces a formation temperature of the additional melt through a slag reaction between the iron ore powder and the auxiliary material. As a result, more of the melt than in a conventional case of sintered ore production is produced, thereby enabling formation of a wider bond contributable to increased strength of a sintered ore product.

Besides, since as a melting point of the melt decreases as a result of a slag reaction between the iron ore powder and the auxiliary material, a viscosity of the melt also decreases, it can be further expected that the melt is easier to migrate over surfaces of particles of the iron ore powder. As a result, the melt spreads all over the surfaces of particles of the iron ore powder in a uniform distribution, which makes it possible for a network structure of bond contributing to increased strength of a sintered ore product to be formed with spatial uniformity.

As compounds used in a process for producing sintered ore of the present invention, there can be used acmite based compounds such as $Fe_2O_3$—$Na_2O$—$SiO_2$ based compounds and $Na_2O$—$SiO_2$ based compounds.

A $Fe_2O_3$—$Na_2O$—$SiO_2$ based compound can easily react with iron oxides such as $Fe_2O_3$, FeO or the like in the iron ore to incorporate the iron oxides into the compound as a solid solution. A solid solubility of the iron oxides has a wide range. Melting points of the $Fe_2O_3$—$Na_2O$—$SiO_2$ based compounds range from 760° C. to close to 1200° C. according to a chemical composition thereof and has a wide composition range having a melting point of 900° C. or lower.

At this point, by using the $Fe_2O_3$—$Na_2O$—$SiO_2$ based compounds in a process for producing sintered ore of the present invention, the compounds are molten at a temperature lower than a conventional sintering temperature ranging from 1150 to 1200° C. for sintered ore to form a melt, with the result that the melt reacts with iron oxides in the iron ore. Further, the iron oxides are dissolved in the melt of the $Fe_2O_3$—$Na_2O$—$SiO_2$ based compounds and accelerate further formation of a melt, wherein since a composition range having a melting point of 900° C. or lower is wide, formation of the melt is accelerated. With the melt, still further formation of a melt can be accelerated through a slag reaction between the iron ore powder and the auxiliary material, leading to formation of a sufficient amount of the melt for sintering of the iron ore powder, and thereby enabling the strength of a sintered ore product to be improved.

That is, when the $Fe_2O_3$—$Na_2O$—$SiO_2$ based compounds of compositions having a melting point of 900° C. or lower are used in a process for producing sintered ore of the present invention, a melt can be produced at a temperature lower than the above described sintering temperature, or of 900° C. or lower, thereby enabling a further increase in strength of a sintered ore product.

In addition to this, the $Na_2O$—$SiO_2$ based compounds can also be used in a process for producing sintered ore of the present invention. Melting points of the $Na_2O$—$SiO_2$ based compounds range from about 1020° C. to about 1090° C. A$Na_2O$—$SiO_2$ based compound also reacts with iron oxides in the iron ore powder as described above with ease and a melt of a $Fe_2O_3$—$Na_2O$—$SiO_2$ based compound is formed through dissolution of the iron oxides into the $Na_2O$—$SiO_2$ based compound to form a solid solution. Thereafter, formation of an additional melt through a slag reaction between the iron ore powder and the auxiliary material is accelerated, leading to formation of a sufficient amount of the melt for sintering of the iron ore powder, and thereby enabling the strength of a sintered ore product to be improved.

As water-soluble compounds used in a process for producing sintered ore of the present invention, sodium silicates ($Na_2O$—$SiO_2$ based compounds) are preferably used. Since sodium silicates are dissolved in water with ease, an aqueous solution of a compound with a desire concentration can be prepared.

As sodium silicates used in the present invention, not only sodium metasilicate ($Na_2SiO_3$) but also anhydrous salts such as sodium orthosilicate ($Na_4SiO_4$) can be used. Furthermore, various kinds of sodium polysilicates such as $Na_2Si_2O_5$ and $Na_2Si_4O_9$, which can be obtained through hydrolysis of the anhydrous salts, can be used.

A process for producing sintered ore of the present invention has an effect to enable a high-strength sintered ore product, which exerts no adverse influence on operation in a blast furnace to be produced.

DETAILED DISCLOSURE OF THE INVENTION

Detailed description will be made of the present invention in the following examples.

In mixing and granulating steps, iron ore powder and auxiliary materials were mixed at a blending composition shown in Table 1 thereafter, an aqueous solution shown in Table 2 was added to the mixture in amount of 7 mass % and the mixture is transformed into granules using a drum mixer to prepare two kinds of granules (specimen A for an example of the present invention and specimen B for an comparative example).

In an example of the present invention, as shown in Table 2, the aqueous solution was in advance prepared as a sodium metasilicate ($Na_2SiO_3$:$Na_2O.SiO_2$) aqueous solution by adding powdery sodium metasilicate to water in a ratio of 1 g per 100 g (1 mass %) and the sodium metasilicate aqueous solution was added to the iron ore powder and the auxiliary materials. At this time, the sodium metasilicate thus added is hydrolyzed as in the following reaction formula to form sodium polysilicate:

$$Na_2SiO_3+H_2O \rightarrow Na_2Si_2O_5+2NaOH$$

With this hydrolysis, sodium polysilicate ($Na_2Si_2O_5$: an acmite based compound) is obtained.

TABLE 1

| | composition (mass %) |
|---|---|
| iron ore H(HGO) | 26.0 |
| iron ore H(F) | 18.0 |
| iron ore H(C) | 1.1 |
| iron ore H(RD) | 5.5 |
| iron ore H(RR) | 25.0 |
| iron ore H(Y) | 10.0 |
| lime stone | 12.0 |
| quick lime | 2.0 |
| silica rock | 0.4 |
| subtotal | 100.0 |
| return sintered ore | 25.0 |
| coke powder | 5.5 |
| aqueous solution | 7.0 |

TABLE 2

| specimen name | A (present invention) | B (comparative example) |
|---|---|---|
| additive amount of sodium silicate into aqueous solution (mass %) | 1.0* | 0 (no addition) |

Note: *an additive amount of sodium silicate into granules: 0.07 mass %

Chemical compositions of respective blending iron ore powder used in the example is shown in Table 3 and a particle size distribution of the blended iron ore powder is shown in Table 4.

TABLE 3

| names of iron ore (sintering raw material) | T. Fe | $SiO_2$ | $Al_2O_3$ | crystallization water |
|---|---|---|---|---|
| iron ore H(HGO) | 63.5 | 4.2 | 2.1 | 2.2 |
| iron ore H(F) | 62.8 | 4.2 | 2.5 | 3.1 |
| iron ore C | 67.6 | 0.4 | 0.8 | 1.5 |
| iron ore RD | 66.1 | 1.2 | 1.1 | 2.1 |
| iron ore RR | 57.2 | 5.4 | 2.7 | 10.1 |
| iron ore Y | 59.1 | 5.0 | 1.3 | 8.6 |

TABLE 4

| particle size (mm) | 0.125 or less | 0.125 to 0.25 | 0.25 to 0.5 | 0.5 to 1 | 1 to 2 | 2 to 5 | 5 to 10 | 10 or more |
|---|---|---|---|---|---|---|---|---|
| particle size distribution (mass %) | 14.2 | 5.8 | 7.0 | 11.4 | 15.0 | 27.7 | 16.3 | 2.7 |

Average particle size: 2.73 mm

Samples were partly taken from the above described two kinds of granules (specimen A for an example of the present invention and specimen B for a comparative example) to measure respective particle size distributions after drying. Results are shown in FIG. 1.

Figure 1:
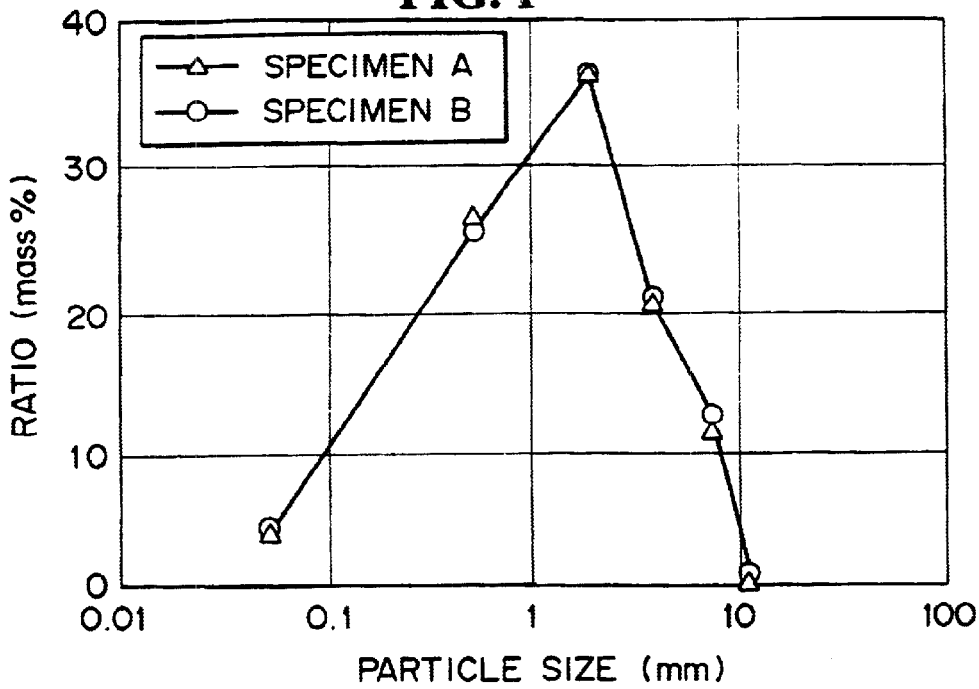
FIG. 1 is a graph showing a particle size distribution of agglomerated particles in an example of the present invention.

As clearly seen from FIG. 1, the specimens A and B were both composed of sufficiently agglomerated particles and no difference therebetween in particle size distribution was recognized. In such a way, it was found that even when an aqueous solution contained a trace of sodium metasilicate, the same granulating nature required for an ironmaking raw material as in a conventional process was able to be achieved.

Then, the two kinds of granules were subjected to a sintering experiment using a sintering pan. The sintering experiment was such that the granules were packed in the sintering pan with a diameter of 100 mm and a height of 300 mm, the top surface was ignited in succession to the packing and sintering was performed while sucking the air at an suction pressure of 3500 Pa.

Figure 2:
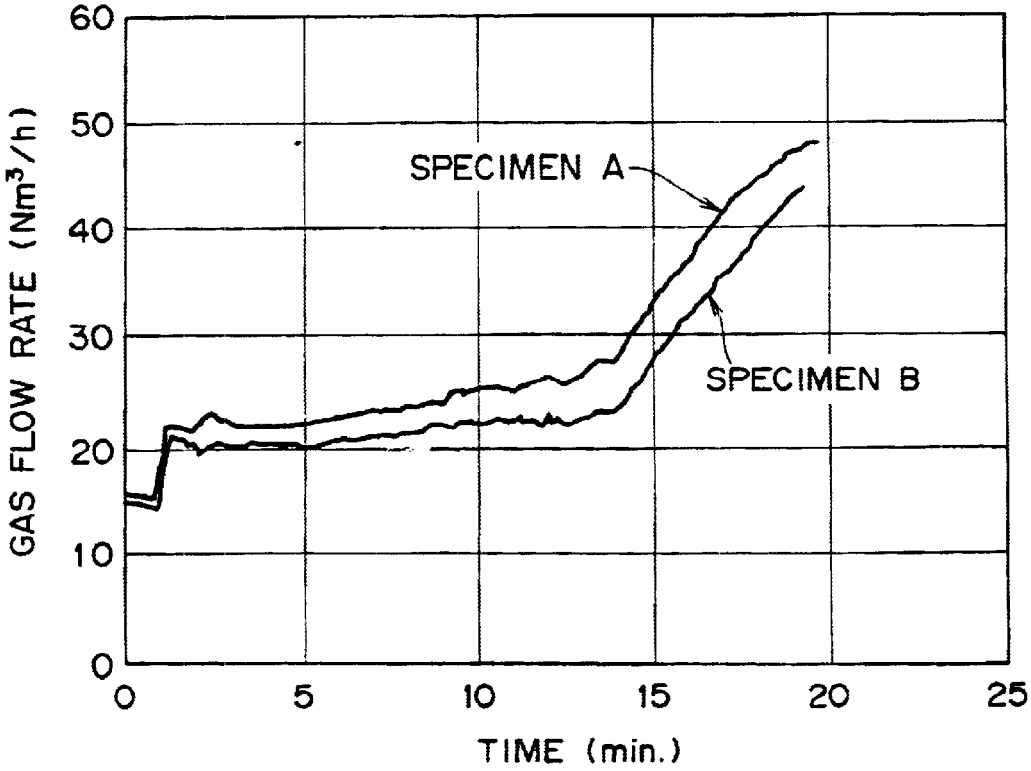
FIG. 2 is a graph showing changes in gas flow rates during sintering in a sintering pan in an example of the present invention.
Figure 3:
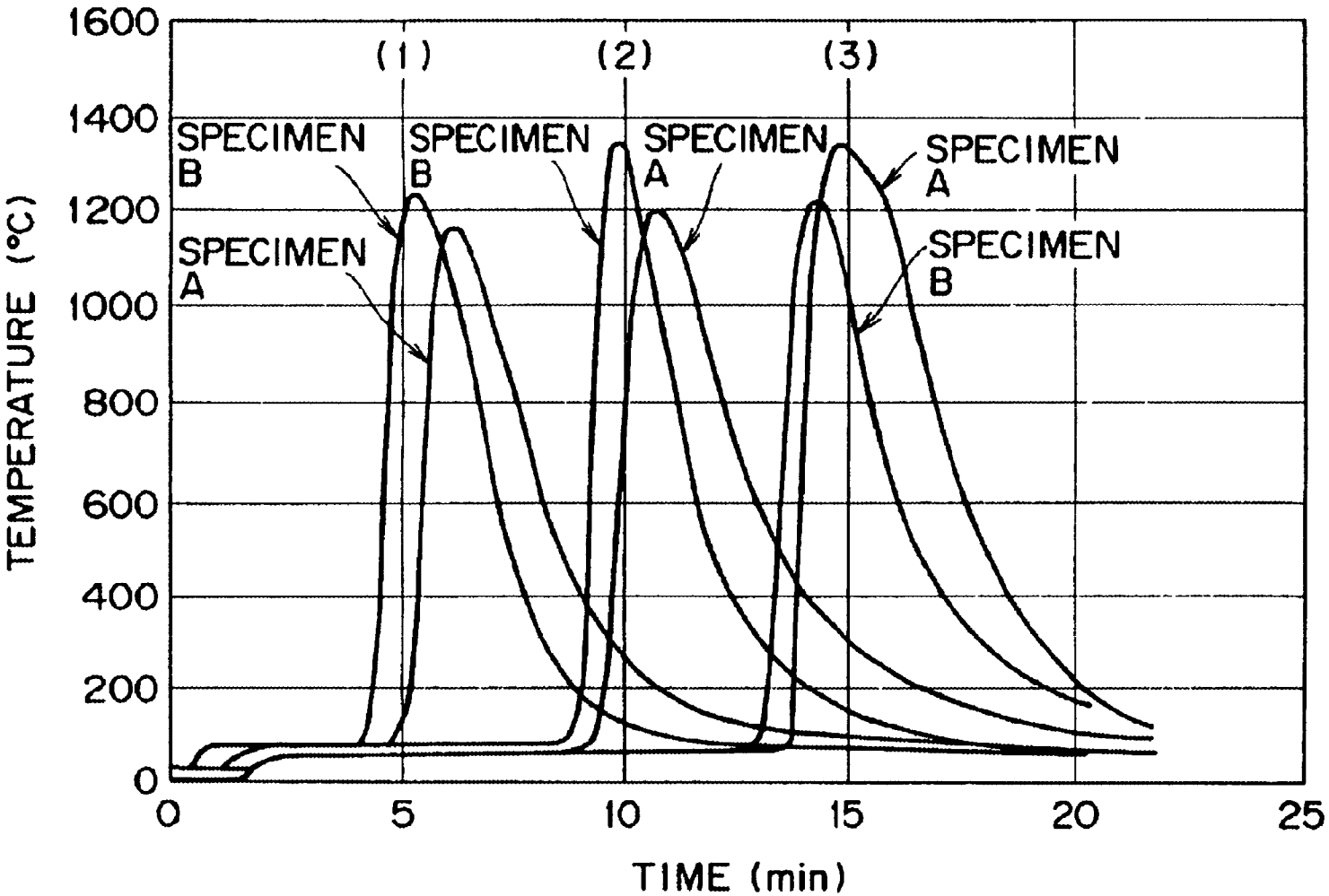
FIG. 3 is a graph showing changes in temperature at positions in a packed bed during sintering in a sintering pan in an example of the present invention.

In this operation, a change in gas flow rate along with changes in temperature at positions in the packed bed during the sintering in the sintering pan were measured, which results are shown in FIGS. 2 and 3.

Figure 4:
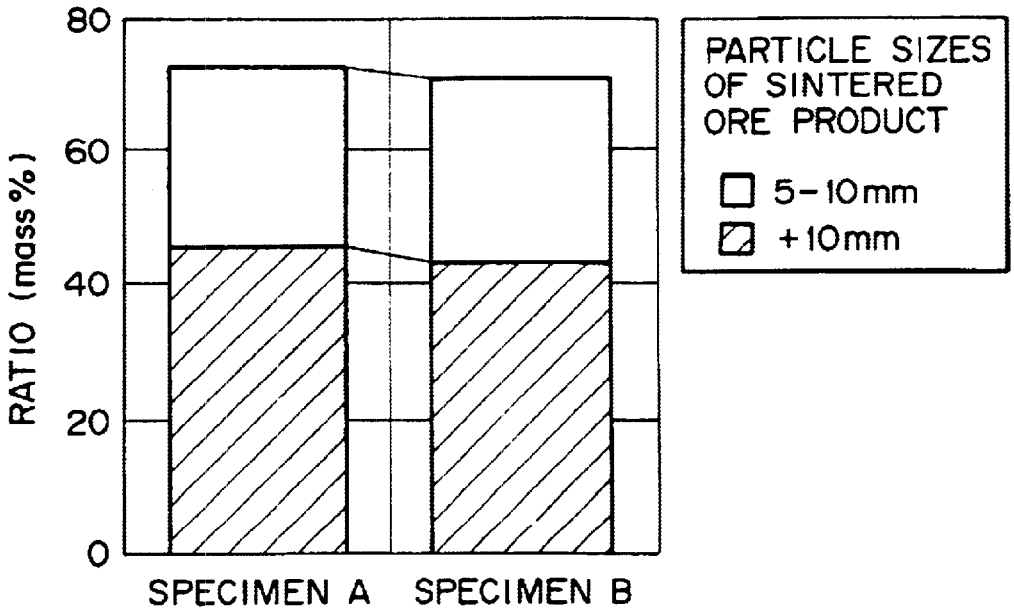
FIG. 4 is a histogram showing particle size compositions after a drop test of sintered ore in an example of the present invention.
Figure 5:
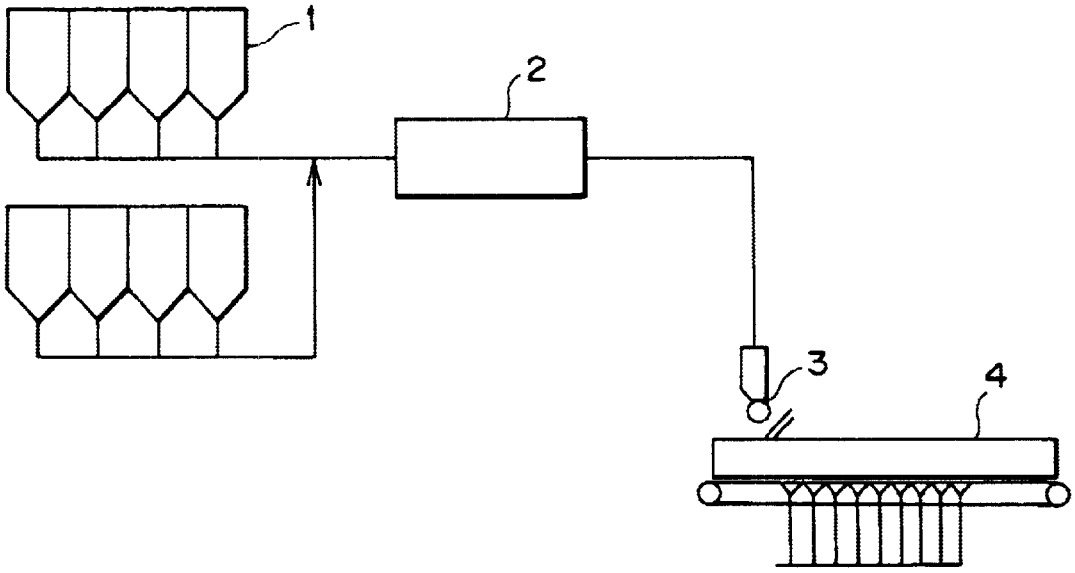
FIG. 5 is an illustration showing a preliminary process for a sintering raw material.

Furthermore, after the sintering, drop test strengths of the sintered ore products were measured, which results are shown in FIG. 4.

FIG. 2 is a graph showing changes in gas flow rate during the sintering in the sintering pan.

FIG. 3 is a graph showing changes in temperature at the positions: the top position (1) in the figure, 100 mm in depth from the surface of a packed bed of granules in the sintering pan, the middle position (2) in the figure, 200 mm in depth from the surface and the bottom position (3) in the figure, 300 mm in depth from the surface. The ordinate represents temperature and the abscissa represents an elapse time in the sintering experiment. As time elapsed, a maximum temperature moved, as described above, starting from the top position through the middle position then to the bottom position, which positional movement of the maximum temperature is caused by changes in temperature in the packed bed in the course where solid fuel in the top layer section is ignited and thereafter the solid fuel is burned downwardly.

FIG. 4 is a graph showing a drop test strength of a sintered ore product after the sintering in the sintering pan. The drop test strength was obtained in such a manner that a sample of a sintered ore product was dropped from a height of 2 m onto a iron table all at a time, such a test was repeated on the same sample 4 times and thereafter all of the sintered ore product sample was screened with two kinds of sieves having respective apertures of 5 mm and 10 mm to divide into two portions; one passing through the 10 mm sieve but retained on the 5 mm sieve and the other retained on the 10 mm sieve, and obtain ratios by mass % therebetween.

Description will be made of results of the sintering experiment in the sintering pan in the example.

(1) Changes in gas flow rate during the sintering in the sintering pan (see FIG. 2)

It was found that the specimen A of an example of the present invention (in which an aqueous solution containing sodium metasilicate is used) had more of a gas flow rate and was more excellent in air flowing-through property than the specimen B of a comparative example.

That is, although granules of the specimen A show almost the same particle size distribution as that of the specimen B, the specimen A is excellent in the gas flowing-though property in the sintering operation compared with the specimen B.

As a result, as described in the conventional example, a gas flowing-through resistance of a packed bed of granules on a pallet of the sintering machine can be reduced and a higher temperature can be generated and maintained by combustion of the solid fuel in the granules, thereby enabling a higher strength sintered ore product to be produced.

Why the specimen A of the example of the present invention had an improved gas flowing-through property is to be still investigated, but the following reason is considered as one of factors for the phenomenon.

In general, in a case of aggregate of particles with the same size, as surfaces of the particles are smoother, an air flowing-through property is better. If this applies to this case, it can be conceived that surfaces of granules constituting the specimen A are smoother than those of the specimen B, and the specimen A is better in gas flowing-through property than the specimen B.

It is further considered in connection with smoothness of surfaces of the granules that the surfaces of granules of the specimen A become smoother by attachment of auxiliary materials, such as quick lime and lime stone, and fine ore particles over surfaces of nuclear particles of the iron ore powder in an almost uniform manner. The reason why the auxiliary materials and fine ore particles attach over nuclear particles of iron ore powder in an almost uniform manner is estimated that an aqueous solution contains sodium metasilicate, that is Na (an alkali metal). With Na included in the aqueous solution, it can be expected that a viscosity of the aqueous solution added to the iron ore powder and the auxiliary materials is reduced and as a result, it can be further imagined that the auxiliary materials such as quick lime and lime stone and fine ore particles can be attached around all nuclear particles of the iron ore powder in an almost uniform manner.

(2) Changes in temperature at positions in the packed beds during the sintering in the sintering pan(see FIG. 3)

At the bottom position ((3) in the figure) of the packed bed of the sintering pan, a maximum temperature of the specimen A was higher than that of the specimen B and a time held at 1100° C. or higher was longer in the specimen A than in the specimen B. At the middle point ((2) in the figure) of the packed bed of the sintering pan, a maximum temperature of the specimen B was higher than that of the specimen A while there was recognized no difference in time held at 1100° C. or higher between the specimen A and the specimen B. On the other hand, at the top position ((1) of the figure) of the packed bed of the sintering pan, the specimen A is lower or shorter in a maximum temperature or a time held at 1100° C. or higher than the specimen B.

(3) A drop test strength of a sintered ore product after sintering in the sintering pan (see FIG. 4)

It was recognized that the specimen A of an example of the present invention is more excellent in drop test strength of a sintered ore product than the specimen B.

The reason of improvement on drop test strength of the specimen A is considered that in the specimen A, since a gas flowing-through property in sintering is improved, a maximum temperature at the bottom position of the packed bed is higher and a time held at a temperature of 1100° C. or higher is longer, whereby sufficient sintering of granules is performed.

Furthermore, the specimen A of the present invention can produce a melt at a temperature lower than a conventional sintering temperature (1150° C. to 1200° C.) for sintered ore by addition of sodium metasilicate producing a reaction product having a low melting temperature (about 600° C.) through a reaction with iron ore. As described above, it is conceived that, with thus produced melt, formation of an additional melt through a slag reaction between the iron ore powder and the auxiliary materials is accelerated, thereby realizing sufficient sintering of iron ore powder.

This leads to a suggestion that since, although a maximum temperature or a time held at a temperature of 1100° C. or higher are lower or shorter at the top position of the packed bed of the specimen A than at the position of the specimen B (see FIG. 3), a drop test strength of a sintered ore product is higher in the specimen A than in the specimen B, therefore sufficient sintering is performed in the top section of the packed bed of the specimen A.

Furthermore, as described above, since it can be expected that the auxiliary materials such as quick lime and lime stone and fine iron ore powder are attached on the surfaces of all nuclear particles of iron ore powder in an almost uniform manner with the help of Na (alkali metal) of sodium silicate contained in the aqueous solution, it is conceived that an additional melt can be produced from all the nuclear particles of the iron ore powder through a slag reaction between the iron ore powder and the auxiliary materials and production of the additional melt for sintering iron ore powder can be effected uniformly in the packed bed, thereby improving a drop test strength of a sintered ore product of the specimen A.

In such a manner, in a process for producing sintered ore of the present invention, when a small amount of a compound was added to iron ore powder, the strength of the sintered ore product was able to be improved without any increase in additive amount of an auxiliary material (CaO) serving as a binder.

With improvement on the strength of a sintered ore product, not only is product yield increased but also a sufficient crushing strength as a sintered ore product used in a blast furnace can be attained.

In the examples, while 2 mass % CaO is used as a binder, there is no limitation to this but not only can an amount thereof be altered but other binders such as bentonite, cement and cement clinker in powder, can be substituted therefor.

Further, it was found that in the examples, 20 mass % iron ore with high crystallization water was mixed into a sintering raw material and a high strength sintered ore product was able to be produced according to a process for producing sintered ore of the present invention.

Especially, a process for producing sintered ore of the present invention is characterized in that the strength of a sintered ore product is improved by adding sodium silicate containing an alkali metal into an ironmaking raw material which conventionally exerted an adverse influence on operation of a blast furnace.

Further, in a process for producing sintered ore of the present invention, an additive amount of sodium silicate as a compound can be smaller and thereby increase in alkali metal contained in sodium silicate is reduced, with the result that adverse influences such as alkali attachment, alkali circulation on operation of a blast furnace can be suppressed smaller.

The reason why is that since the present invention employs an aqueous solution of sodium silicate using a characteristic thereof of being easily soluble in water and thereby, not only can particles of iron ore powder be coated with sodium silicate when drying but a reaction between sodium silicate and iron ore powder can be efficiently performed, so that an additive amount of sodium silicate can be smaller.

According to the present invention, if an additive amount of sodium silicate is 0.01 mass % or more, an amount of a melt necessary for performing liquid phase sintering of iron ore powder can be produced at a comparatively low sintering temperature (about 600° C.). Further, since as an additive amount of sodium silicate is increased, an amount of the melt necessary for liquid phase sintering of iron ore powder is increased and thereby, the strength of sintered ore can be improved, therefore, an additive amount of sodium silicate is preferably increased.

On the other hand, since an increase in alkali is higher and disintegration during reduction becomes aggravated by increasing an additive amount of sodium silicate, an upper limit of an additive amount of sodium silicate is 1.0 mass %, preferably 0.5 mass % and more preferably 0.3 mass %.

At this point, sodium silicates employed in the present invention is not limited to sodium metasilicate, but there can be used instead an anhydrous salt of sodium orthosilicate ($Na_4SiO_4$ and so on) and further various kinds of sodium polysilicates such as $Na_2Si_2O_5$ and $Na_2Si_4O_3$, which are obtained through hydrolysis of aqueous solution of the anhydrous salts of sodium metasilicate or sodium orthosilicate.

Furthermore, a process for producing sintered ore of the present invention is not limited to description of the examples of the present invention but compounds used in a process for producing sintered ore of the present invention is only required to be a compound which reacts with iron ore and has a melting point of 1200° C. or lower, and there can be used acmite based compounds other than sodium silicate such as $Fe_2O_3$—$Na_2O$—$SiO_2$ based compounds and $Na_2O$—$SiO_2$ based compounds. Furthermore, as additives other than the acmite based compounds, there can be used phosphoric acid based compounds such as sodium phosphate and calcium dihydrogenphosphate.

What is claimed is:

1. A process for producing sintered iron ore comprising the steps of:

kneading iron ore powder, an auxiliary material and an aqueous solution to form a mixture, said aqueous solution containing a water-soluble compound reacting with said iron ore powder to form a reaction product having a melting point of 1200° C. or lower;

granulating said mixture obtained in said kneading step to form granules; and sintering said granules formed in said granulating step to obtain sintered ore.

2. The process for producing sintered iron ore according to claim 1, wherein said aqueous solution contains a water-soluble compound reacting with the iron ore powder to form a reaction product having a melting point ranging from 550 to 900° C.

3. The process for producing sintered iron ore according to claim 2, wherein said water-soluble compound is an acmite based compound.

4. The process for producing sintered iron ore according to claim 3, wherein said water-soluble compound is sodium silicate.

5. The process for producing sintered iron ore according to claim 4, wherein a content of sodium silicate in said aqueous solution is in the range of from 0.01 to 1.0 mass %.

6. The process for producing sintered iron ore according to claim 5, wherein a content of sodium silicate in said aqueous solution is in the range of from 0.01 to 0.3 mass %.

7. A process for producing sintered iron ore comprising the steps of:

kneading iron ore powder, an auxiliary material and an aqueous solution to form a mixture, said aqueous solution containing a water-soluble compound reacting with said iron ore powder to form a reaction product having a melting point ranging from 550 to 900° C.;

granulating said mixture obtained in said kneading step to form granules; and sintering said granules formed in said granulating step to obtain sintered ore, wherein said water-soluble compound is a phosphoric acid based compound.

8. Sintered ore produced by means of a process for producing sintered ore according to claim 1.

* * * * *